US008151418B2

(12) United States Patent
Nakayama et al.

(10) Patent No.: US 8,151,418 B2
(45) Date of Patent: Apr. 10, 2012

(54) STRETCHABLE FASTENER STRINGER AND SLIDE FASTENER

(75) Inventors: Eiji Nakayama, Toyama-Ken (JP); Hiroyuki Konokawa, Toyama-Ken (JP); Takahiko Aoki, Toyama-Ken (JP); Takumi Arai, Toyama-Ken (JP); Yuichi Miyazaki, Toyama-Ken (JP)

(73) Assignee: YKK Corporation (JP)

( * ) Notice: Subject to any disclaimer, the term of this patent is extended or adjusted under 35 U.S.C. 154(b) by 398 days.

(21) Appl. No.: 12/607,263

(22) Filed: Oct. 28, 2009

(65) Prior Publication Data

US 2010/0107374 A1 May 6, 2010

(30) Foreign Application Priority Data

Oct. 31, 2008 (JP) ..... 2008-281757

(51) Int. Cl.
*A44B 19/08* (2006.01)

(52) U.S. Cl. ..... 24/392; 24/393; 24/394; 24/396

(58) Field of Classification Search ..... 24/392–396
See application file for complete search history.

(56) References Cited

U.S. PATENT DOCUMENTS

| | | | | | |
|---|---|---|---|---|---|
| 3,136,016 | A * | 6/1964 | Firing | 24/393 |
| 3,290,747 | A * | 12/1966 | Burbank | 24/394 |
| 3,524,479 | A * | 8/1970 | Burbank | 139/384 R |
| 3,825,977 | A * | 7/1974 | Takamatsu | 24/394 |
| 3,831,228 | A * | 8/1974 | Jakob | 24/394 |
| 3,908,242 | A * | 9/1975 | Reynolds | 24/395 |
| 4,215,729 | A * | 8/1980 | Ofusa | 139/384 B |
| 4,321,733 | A * | 3/1982 | Yoshida | 24/393 |
| 4,888,859 | A * | 12/1989 | Horita | 24/389 |
| 4,924,560 | A * | 5/1990 | Matsuda et al. | 24/392 |
| 5,313,989 | A * | 5/1994 | Frohlich | 139/384 B |
| 5,472,019 | A * | 12/1995 | Shimono | 139/384 B |
| 5,502,986 | A * | 4/1996 | Matsuda et al. | 66/193 |
| 5,794,460 | A * | 8/1998 | Matsuda et al. | 66/193 |
| 6,148,643 | A * | 11/2000 | Matsuda et al. | 66/193 |
| 6,497,015 | B1 * | 12/2002 | Kato et al. | 24/394 |
| 6,516,499 | B2 * | 2/2003 | Yamaguchi et al. | 24/391 |
| 6,742,226 | B2 * | 6/2004 | Matsuda et al. | 24/436 |
| 6,971,253 | B2 * | 12/2005 | Matsuda et al. | 66/193 |
| 7,240,521 | B2 * | 7/2007 | Matsuda | 66/193 |
| 7,520,032 | B2 * | 4/2009 | Kousaka et al. | 24/395 |
| 7,992,266 | B2 * | 8/2011 | Horikawa et al. | 24/393 |

(Continued)

FOREIGN PATENT DOCUMENTS

JP 63-294804 A 12/1988

(Continued)

*Primary Examiner* — Jack W. Lavinder
(74) *Attorney, Agent, or Firm* — Kilpatrick Townsend & Stockton LLP

(57) ABSTRACT

A stretchable fastener stringer for a slide fastener includes a fastener tape having a tape main portion and an element attaching portion and a continuous fastener element which is attached to the element attaching portion. The fastener tape has stretchability due to an elastic yarn being combined by weaving or knitting and the fastener element includes a coupling head, upper and lower leg portions which are extended from the coupling head and a connecting portion which connects the upper and lower leg portions, therebetween of adjacent fastener elements. In this fastener stringer, a value of a bulging ratio which is the ratio between a dimension of the coupling head in the tape longitudinal direction and a dimension of the upper and lower leg portions in the tape longitudinal direction is set to be larger than 1.80 and not larger than 2.33.

10 Claims, 3 Drawing Sheets

U.S. PATENT DOCUMENTS

2003/0009860 A1* 1/2003 Yang ..... 24/396
2003/0110599 A1* 6/2003 Wang ..... 24/396
2006/0200950 A1* 9/2006 Kousaka et al. ..... 24/396
2008/0209694 A1 9/2008 Horikawa et al.
2009/0070968 A1* 3/2009 Weng ..... 24/391

FOREIGN PATENT DOCUMENTS

JP 2008-043432 A 2/2008

* cited by examiner

STRETCHABLE FASTENER STRINGER AND SLIDE FASTENER

CROSS-REFERENCE TO RELATED APPLICATION

The present application claims priority from Japanese Patent Application No. 2008-281757 filed on Oct. 31, 2008, and is hereby incorporated by reference in its entirety herein.

BACKGROUND OF THE INVENTION

1. Field of the Invention

The present invention relates to a fastener stringer for a slide fastener which is used in stretchable clothes such as sporting clothes, and in particular, relates to a fastener stringer for a slide fastener which is capable of preventing occurrence of chain breaking even when an element attaching portion is stretched.

2. Description of the Related Art

In the related art, a slide fastener has been used in various products such as clothes, bags and the like. For example, slide fasteners have also been used popularly in stretchable clothes such as knit fabric clothes and sporting clothes. Slide fasteners used in various kinds of stretchable clothes need to be attached to the clothes with excellent appearance and to be adapted to expansion and contraction of the clothes. Therefore, some stretchability is added to a fastener tape by selecting weaving structure or knitting structure, material of composition yarns or the like when the slide fastener tape is woven or knitted. Further, it has been known that the appearance of the slide fastener formed with a woven fastener tape is generally better than that formed with a knitted fastener tape.

In the case that some stretchability in the tape longitudinal direction is added to the fastener tape of the slide fastener, the element attaching portion to which the fastener element formed at one side edge of the fastener tape is configured not be stretchable while adding appropriate stretchability to the tape main portion of the fastener tape in the tape longitudinal direction by utilizing elastic yarns for some warp yarns, for example.

The reason is as described in the following. For example, in the case that some stretchability is added to both of the tape main portion and the element attaching portion of the fastener tape, when the element attaching portion of the fastener tape is stretched, an element row which is attached to the element attaching portion is stretched accordingly. When the fastener tape is stretched in a state that the bilateral fastener element rows are coupled and the element rows are stretched to some extent or more in the tape longitudinal direction, the coupling of the elements is released. Thus, a problem of the slide fastener opening laterally which is called chain breaking is apt to occur. For this reason, with a general slide fastener, the element attaching portion of the fastener tape is often configured to be non-stretchable.

For example, assuming that the slide fastener of which tape main portion is configured to be stretchable and of which element attaching portion is configured to be non-stretchable is attached to stretchable clothes, in this case, when a user performs an exercise such as stretching his or her body while wearing the stretchable clothes, the element attaching portion is not stretched while the tape main portion is stretched or contracted in accordance with the stretching or contraction of the clothes. Therefore, a strained phenomenon may occur at the clothes to which the slide fastener is attached. In addition, terrible disharmonized feeling may be induced in appearance when such clothes are worn.

In order to solve such a problem, a slide fastener which has some stretchability added to a vicinity of the element attaching portion as well as to the tape main portion has been disclosed, for example, in Japanese Patent Application Laid-Open No. 63-294804 and Japanese Patent Application Laid-Open No. 2008-43432.

For example, the slide fastener disclosed in JP-A No. 63-294804 includes elastic yarns (Spandex covered yarns) which are arranged regularly at specific intervals and non-stretchable yarns which are arranged at the rest of the part as warp yarns constituting the tape main portion and the element attaching portion of the fastener tape when the fastener tape is woven. Further, a coil-shaped element row in which a core thread is inserted is sewn to the element attaching portion of the fastener tape with a sewing yarn. The core thread is configured so that an elastic yarn is covered with a cover layer which is formed of a polyester bulky processed yarn (non-elastic yarn).

The slide fastener of JP-A No. 63-294804 having the abovementioned configuration has a degree of stretching that the element attaching portion is stretched by 10% or more when a load of 4 kg is applied to the fastener tape in the longitudinal direction, for example, since the elastic yarns are arranged regularly at specific intervals also at the element attaching portion similarly at the tape main portion.

On the other hand, a ratio of the quantity of arranged elastic yarns at the element attaching portion is the same as that at the tape main portion so that numerous non-stretchable yarns are woven also at the element attaching portion. Then, a degree of stretching of the core thread itself is suppressed by being covered with the cover layer which is formed of non-stretchable yarn. Further, the element row and the core thread are sewn to the element attaching portion with a non-stretchable yarn. With this configuration, a pitch between adjacent elements in a state that the fastener stringer is stretched most is limited to less than twice the length of the coupling head of the element row in the tape longitudinal direction.

Accordingly, in the case that the slide fastener of JP-A No. 63-294804 is attached to clothes having stretchability, a slide fastener attaching portion is stretched or contracted in accordance with the stretching of contraction of the clothes. Therefore, the strained phenomenon and disharmonized feeling are not induced so that comfortable wearing feeling and excellent appearance can be obtained. Here, the maximum stretching amount of the element row is limited as described above while some stretchability is added to the element attaching portion of the fastener tape. Therefore, even when the element attaching portion is stretched, occurrence of the chain breaking in the slide fastener due to release of coupling of the fastener elements can be prevented.

Moreover, a slide fastener of which stretchability is further enhanced than the slide fastener of JP-A No. 63-294804 is described in JP-A No. 2008-43432. For example, for sporting clothes, further enhanced stretchability is desired and developed in order to improve the product value. Accordingly, further enhanced stretchability has been desired for a slide fastener which is attached to such clothes having enhanced stretchability.

Then, in the slide fastener (fastener stringer) described in JP-A No. 2008-43432, an elastic yarn and a non-elastic yarn are woven in combination serving as the warp yarns at the tape main portion and the element attaching portion of the fastener tape. Further, the weaving ratio of the elastic yarn to the non-elastic yarn at the element attaching portion is set to be larger than that at the tape main portion.

In this manner, by varying the weaving ratio of the elastic yarn at the element attaching portion from that at the tape main portion so that the weaving ratio is larger than that at the tape main portion, the stretchability of the element attaching portion can be greatly enhanced. Specifically, the slide fastener of JP-A No. 2008-43432 is described to possess a degree of stretching with the element attaching portion being stretched by 10% or more when a load of 1 kg is applied to the fastener tape in the longitudinal direction.

Thus, the element attaching portion of the slide fastener of JP-A No. 2008-43432 is capable of being stretched with a small load and has excellent degree of stretching (stretchability) compared to that of the slide fastener of JP-A No. 63-294804. Therefore, even in the case that the slide fastener of JP-A No. 2008-43432 is sewn to fabric having high stretchability, for example, the fastener tape can be easily stretched and contracted smoothly following operation of stretching and contraction of the fabric. Therefore, the strained phenomenon and disharmonized feeling are not induced so that comfortable wearing feeling and excellent appearance can be obtained.

Further, in the fastener stringer of JP-A No. 2008-43432, the stretching amounts of the element attaching portion, the element row and the core thread in the longitudinal direction are limited so that the pitch between the fastener elements in the most stretched state is less than twice the length of the coupling head of the element row in the longitudinal direction. Accordingly, JP-A No. 2008-43432 describes that the chain breaking due to release of coupling of the fastener elements is to be prevented even when the element attaching portion is stretched in the state that the bilateral element rows are coupled.

The slide fasteners having base structure of which fastener tape is stretchable in the tape longitudinal direction are disclosed in JP-A No. 63-294804 and JP-A No. 2008-43432. Although the configuration of each of the fastener elements which forms the element row of the slide fastener is not described in detail, it is supposed from the disclosure that the element row is formed by utilizing a coil-shaped continuous fastener element which is generally used in the related art.

In this case, the general coil-shaped fastener element of the related art is formed by utilizing synthetic resin monofilament of which section is circular. Forming process of the coil-shaped fastener element is described in detail in the following. First, the monofilament of which wire diameter (sectional diameter) is 0.6 mm, for example, is processed to be bent so that the monofilament is wound to be coil-shaped. Subsequently, a projecting portion which bilaterally bulges is formed locally at the monofilament by plastically deforming to be flat with stamping forming. In this manner, the coil-shaped continuous fastener element is formed.

In the abovementioned coil-shaped fastener element of the related art, in the case that the wire diameter of the monofilament is 0.6 mm, generally, the dimension of the coupling head in the tape longitudinal direction (mountain length H) is set to be 1.08 mm and the pitch P between the adjacent fastener elements in the tape longitudinal direction is set to be 1.40 mm considering the coupling strength of the element rows, slidability of a slider and the like. Further, also in the case that monofilament of different wire diameter is used, relative dimensions (ratios) of the mountain length H and the pitch P against the monofilament wire diameter is basically to be constant.

Here, when the coil-shaped fastener element is sewn to the abovementioned stretchable fastener tape, attaching of the coil-shaped fastener element is performed in a state that a predetermined tension force is applied by pulling the fastener tape in the tape longitudinal direction. Thus, the pitch P of the obtained slide fastener in the tape longitudinal direction of the fastener element is generally contracted to approximately 1.37 mm since the tension force of the fastener tape during element attaching is removed.

Here, a case that the element row is formed with a normal coil-shaped fastener element in the slide fastener of which fastener tape and the element row are stretchable in the tape longitudinal direction as mentioned above is described in the following. In the state that the bilateral element rows are coupled, the coupling head of each of the fastener elements enters between upper and lower leg portions of the element of the coupling counterpart so that the coupling heads of respective bilateral element rows are engaged.

Therefore, even when the slide fastener receives force to pull the fastener tape toward the outside in the tape width direction (lateral tension force) in the state that the element rows are coupled, for example, the pitch P of the fastener elements is not expanded and the bilateral coupling heads remain firmly engaged. Therefore, the coupling of the bilateral element rows is not disengaged and the coupled state of the element rows can be maintained.

However, when the stretchable slide fastener receives force to push the element rows in the tape front-back direction (pushing force) in the state that the element rows are coupled, for example, the element rows are locally curved or bent in the tape front-back direction due to the stretchability of the fastener tape. As a result, the pitch P of the fastener elements is expanded at positions where the element rows are curved or bent.

Before receiving the pushing force, the coupling head of the fastener element is engaged with the coupling head of the fastener element of the coupling counterpart which is attached at a predetermined pitch. However, when the pitch P of the fastener elements is expanded by receiving the pushing force, the coupling head at a part which receives the pushing force is disengaged from the fastener element of the coupling counterpart and the coupled state of the element rows cannot be maintained. Therefore, there is a problem that chain breaking is apt to occur at the element rows.

SUMMARY OF THE INVENTION

The present invention has been made in view of the abovementioned problem of the related art. The specific object of the present invention is to provide a slide fastener which is capable of stably maintaining a coupled state of element rows while preventing occurrence of the chain breaking even when the element rows in a coupled state receive pushing force in a slide fastener in which the element row is attached to a stretchable fastener tape, and in particular, to provide a stretchable fastener stringer which is used for the slide fastener.

In order to achieve the abovementioned object, as the basic configuration, the stretchable fastener stringer provided by the present invention includes a fastener tape having a tape main portion and an element attaching portion and a continuous fastener element which is attached to the element attaching portion of the fastener tape. Then, the fastener tape has stretchability due to an elastic yarn being woven or knitted into the tape main portion and the element attaching portion, and the fastener element includes a coupling head, upper and lower leg portions which are extended from the coupling head toward the tape width direction and which are attached to the element attaching portion, and a connecting portion which connects the upper and lower leg portions therebetween of adjacent fastener elements. In this stretchable fastener stringer for a slide fastener, a value of a bulging ratio (=mountain length H/leg portion length d) which is the ratio between mountain length H as a dimension of the coupling head in the tape longitudinal direction and leg portion length d as a dimension of the upper and lower leg portions in the tape longitudinal direction is set to be larger than 1.80 and not larger than 2.33.

In the fastener stringer according to the present invention, it is preferable that a value of a coupling ratio (=(mountain length H+leg portion length d)/pitch P) which is the ratio between a sum of the mountain length H and the leg portion length d and the pitch P between the coupling heads in the tape longitudinal direction of the fastener elements which are adjacent each other is set to be larger than 1.23 and not larger than 1.50.

In the fastener stringer of the present invention, it is preferable that the fastener element is sewn to the element attaching portion with a sewing yarn. In this case, it is preferable that a stretchable core thread is inserted between the upper and lower leg portions of the fastener element.

On the other hand, in the fastener stringer of the present invention, the fastener element may be attached by weaving or knitting simultaneously when the fastener tape is woven or knitted.

Further, according to the present invention, a slide fastener which includes the fastener stringer of the abovementioned configuration is provided.

The inventor of the present invention has repeatedly reviewed means which prevents occurrence of the chain breaking at the slide fastener even when pushing force is applied to the stretchable slide fastener in which a continuous fastener element is attached to a stretchable fastener tape in a coupled state.

As a result, the following findings have been obtained. That is, the coupled state of the element rows is stably maintained even when the pitch P of the fastener elements is expanded with the pushing force being received by the element rows, provided that the mountain length H which is the dimension of the coupling head in the tape longitudinal direction is set to be larger than that in the related art. In addition, the mountain length H can be standardized by defining relatively against the dimension of upper and lower leg portions in the tape longitudinal direction (leg portion length d). The present invention is completed by defining an appropriate numeral range on the ratio between the mountain length H and the leg portion length d based on repeated experiment.

Namely, a fastener element which forms an element row of a stretchable fastener stringer of the present invention is formed so that a value of a bulging ratio (=mountain length H/leg portion length d) which is the ratio between the mountain length H as the dimension of the coupling head in the tape longitudinal direction and the leg portion length d as the dimension of the upper and lower leg portions in the tape longitudinal direction is set to be larger than 1.80 and not larger than 2.33, preferably, between 1.85 and 2.13 inclusive. Here, the stretchable fastener stringer in the present invention denotes a fastener stringer capable of stretching with elasticity, more specifically, denotes a fastener stringer in which a fastener chain is capable of returning to an original dimension (30 cm) in the condition that a load of 1 kg for each 30 cm of tape length in the longitudinal direction is applied to the fastener chain in which bilateral element rows of the fastener stringer are coupled and the load is removed thereafter.

In a general slide fastener to which a coil-shaped or zigzag-shaped continuous fastener element in the related art is attached, the mountain length H is set to be 1.08 mm as mentioned above. Further, in the case that section of monofilament for forming the fastener element is circular, the leg portion length d is to be 0.6 mm because the leg portion length d corresponds to the dimension of the wire diameter (sectional diameter) of the monofilament. Accordingly, a value of the bulging ratio of the continuous fastener element attached to the slide fastener in the related art has been 1.80.

Consequently, in the fastener stringer of the present invention, the bulging ratio as defined for the fastener element is set to be larger than 1.80 of related art, and preferably to be 1.85 or larger. With this configuration, since the dimension of the coupling head of each of the fastener elements in the tape longitudinal direction is larger than that of the related art, the engagement of the coupling heads of the bilateral fastener elements can be maintained and occurrence of the chain breaking at the element rows can be prevented even when the pitch P of the fastener elements is expanded due to the pushing force received by the element rows.

Theoretically, the fastener stringer of the present invention can prevent occurrence of the chain breaking at the element rows even when the pitch P of the fastener elements is stretched about 123% to 146% more than the normal state in which the pushing force etc. is not received.

On the other hand, when the bulging ratio of the fastener element is set to be too large, namely, when the dimension of the coupling head of each of the fastener elements in the tape longitudinal direction is to be too large, the coupling of the bilateral element rows is considered to be difficult to perform since the coupling heads of the adjacent fastener elements overlap in the tape longitudinal direction. Further, for example, when the slider is slid to couple or separate the bilateral element rows, the easiness of sliding is decreased due to increase of sliding resistance of the slider, so that the opening and closing operation of the slide fastener cannot be smoothly performed.

Thus, the bulging ratio of the fastener element is set to be 2.33 or smaller, preferably to be 2.13 or smaller, as mentioned above in consideration with the operability of the slide fastener while preventing overlap between the coupling heads of the adjacent fastener elements in the tape longitudinal direction.

In the fastener stringer of the present invention, a coupling ratio (=(mountain length H+leg portion length d)/pitch P) which is the ratio between the sum of the mountain length H and the leg portion length d and the pitch P of the coupling heads of the fastener element is set to be larger than 1.23 and not larger than 1.50, preferably, to be larger than 1.28 and not lager than 1.46, and more preferably, to be 1.30.

The coupling ratio which is defined with the pitch P as mentioned above denotes the ratio of the coupling head of the fastener element entering between the upper and lower leg portions of the fastener element of the coupling counterpart in the coupled state of the element rows. By setting the coupling ratio to be larger than 1.23, preferably, to be larger than 1.28, the coupling head of the fastener element further enters between the upper and lower leg portions of the fastener element of the coupling counterpart. Accordingly, the occurrence of the chain breaking at the element rows can be prevented further efficiently even when the element rows receive the pushing force.

On the other hand, by setting the coupling ratio to be 1.50 or smaller, preferably, to be 1.46 or smaller, overlapping of the coupling heads of the adjacent fastener elements can be reliably prevented and decrease in operability of the slide fastener can be also prevented.

In the fastener stringer of the present invention, the fastener element is sewn to the element attaching portion with a sewing yarn. Thus, the stretchability of the slide fastener can be easily ensured while stably sewing the fastener element since the fastener element is sewed to the element attaching portion of the stretchable fastener tape with the sewing yarn.

In this case, by inserting the stretchable core thread between the upper and lower leg portions of the fastener element, the coupling operation of the element rows can be stably performed while sewing of the fastener element can be performed stably and reliably.

Further, in the fastener stringer of the present invention, even in the case that the fastener element is attached by weaving or knitting simultaneously when the fastener tape is woven or knitted, the stretchability of the slide fastener can be ensured while the fastener element is stably attached.

In addition, with the slide fastener of the present invention including the fastener stringer as configured as abovementioned, appropriate stretchability can be obtained and the occurrence of the chain breaking at the element rows can be prevented by stably maintaining the engagement of the coupling heads of the bilateral fastener elements even when the bilateral element rows receive the pushing force in the coupled state.

DESCRIPTION OF THE PREFERRED EMBODIMENTS

In the following, preferable embodiments of the present invention are described with reference to the drawings.

Here, the present invention is not limited to the embodiments described below. The present invention may be variously modified as long as the configuration is substantially the same and the similar operation and effect are obtained. For example, in the description of the following embodiments, the fastener stringer is formed by sewing a coil-shaped continuous fastener element to an element attaching portion of the woven fastener tape. However, the invention is not limited to this, and the fastener stringer of the present invention may be formed by sewing a zigzag-shaped fastener element instead of the coil-shaped fastener element, for example.

Further, the slide fastener of the present invention is not limited to be formed by sewing the continuous fastener element to the element attaching portion of the fastener tape after the fastener tape is woven. The fastener tape may be knitted. In addition, the continuous fastener element may be attached by weaving or knitting simultaneously when the fastener tape is woven or knitted.

Figure 1:
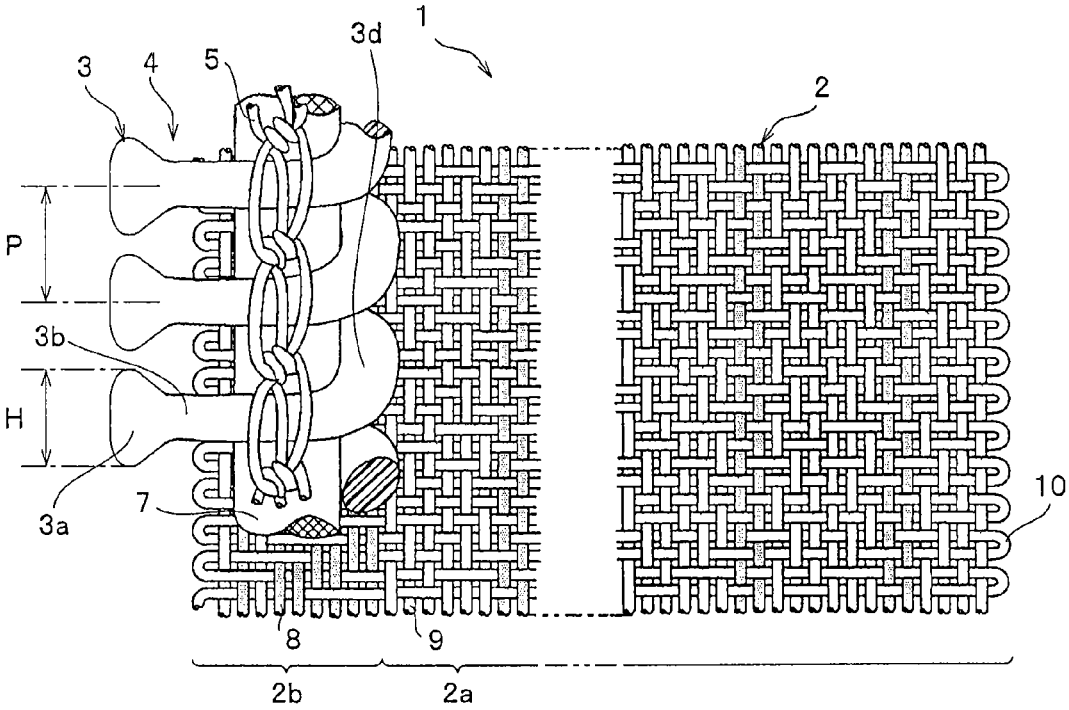
FIG. 1 is a view which schematically illustrates the configuration of a fastener stringer and weaving structure of a fastener tape according the present invention.
Figure 2:
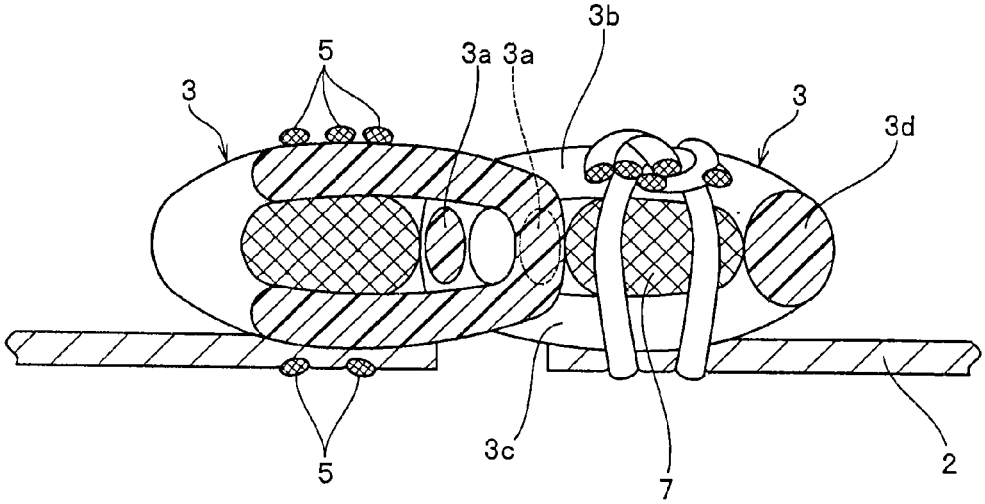
FIG. 2 is a sectional view which schematically illustrates a section of a coupled state of element rows of the fastener stringers.
Figure 3:
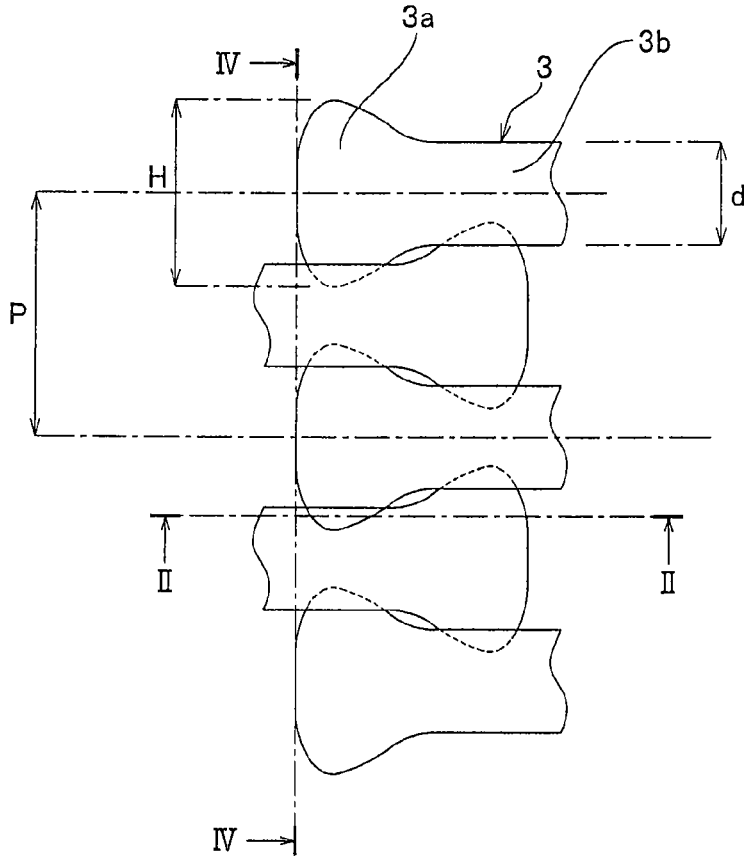
FIG. 3 is an explanatory view which illustrates mountain length H, leg portion length d and a pitch P of the fastener stringer.
Figure 4:
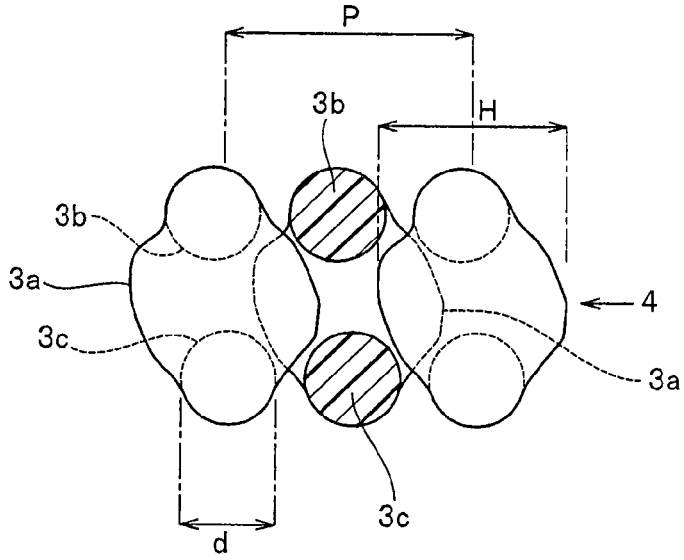
FIG. 4 is a partially sectioned view at line IV-IV of FIG. 3.

Here, FIG. 1 is a view which schematically illustrates the configuration of the fastener stringer and weaving structure of the fastener tape according the present embodiment. FIG. 2 is a schematic sectional view which illustrates a section of a coupled state of element rows of the fastener stringer. FIG. 2 is a view of the fastener stringer sectioned at line II-II of FIG. 3. FIG. 3 is an explanatory view which illustrates mountain length H, leg portion length d and a pitch P of the fastener stringer. FIG. 4 is a partially sectioned view at line IV-IV of FIG. 3.

The fastener stringer 1 according to the present embodiment includes a fastener tape 2 which has a tape main portion 2*a* and an element attaching portion 2*b*, a coil-shaped continuous fastener element 3 which is sewn to the element attaching portion 2*b* with a sewing yarn 5, and a core thread 7 which is inserted through the fastener element 3 and which is sewn with the sewing yarn 5 together with the fastener element 3.

Here, the element attaching portion 2*b* of the present invention refers to an area including at least a part of the fastener tape 2 overlapping the core thread 7 (tape portion which is overlapped by the core thread 7) in the tape width direction, in particular, refers to a tape portion overlapping the continuous fastener element 3 (tape portion which is overlapped by the fastener element 3 row).

The fastener tape 2 of the present embodiment has basically the same configuration as the fastener tape used in JP-A No. 63-294804. That is, the element attaching portion 2*b* is formed along one side edge of the tape main portion 2*a* in the fastener tape 2. At the tape main portion 2*a* and the element attaching portion 2*b* of the fastener tape 2, an elastic yarn 8 and a non-elastic yarn 9 are woven in combination serving as warp yarns and a non-elastic yarn 10 is woven serving as a weft yarn.

In the present embodiment, a Spandex covered yarn which is constituted by winding a polyester filament yarn around a polyurethane elastic yarn is used for the elastic yarn 8 serving as the warp yarn. Then, a polyester processed yarn is used for the non-elastic yarns 9, 10 serving as the warp yarn and the weft yarn.

In the present invention, materials of the elastic yarn 8 and the non-elastic yarns 9, 10 are not particularly limited. For example, the elastic yarn 8 may be appropriately selected from rubber yarns of other elastomer, covered yarns obtained by winding a spun yarn or filament around the rubber yarns and the like. In addition, a generally used yarn in the related art such as a spun yarn, monofilament and multifilament may be used for the non-elastic yarns 9, 10 serving as the warp yarn or the weft yarn.

Further, size of the elastic yarn 8 and the non-elastic yarns 9, 10 is not particularly limited. However, for example, it is preferable to use the elastic yarn 8 and the non-elastic yarns 9, 10 which are formed to be capable of applying appropriate strength to the fastener tape 2 and of which size is capable of allowing a sewing needle to pass through when the continuous fastener element 3 is sewn to the element attaching portion 2*b*.

In the present embodiment, as illustrated in FIG. 1, two elastic yarns 8 are arranged side by side after every six non-elastic yarns 9 are arranged and the elastic yarns 8 are regularly woven at predetermined intervals so that the quantity ratio of the non-elastic yarns 9 is larger than that of the elastic yarns 8 for the warp yarns of the tape main portion 2*a*. Thus, the stretchability of the tape main portion 2*a* in the tape longitudinal direction can be provided evenly in the tape width direction.

On the other hand, seven elastic yarns 8 and two non-elastic yarns 9 are woven at the element attaching portion 2*b*. The non-elastic yarn 9 is used for the warp yarn arranged at a selvedge which is to be an edge of the fastener tape 2 so that the shape of the fastener tape 2 itself is stabilized. Further, from the non-elastic yarn 9 toward the tape main portion 2*a*, the elastic yarns 8 and the non-elastic yarns 9 are alternately arranged repeatedly once or more. Then, the elastic yarns 8 are continuously arranged side by side at an area more to the tape main portion 2*a* side than the alternately arranged elastic yarns 8 or the non-elastic yarns 9.

In this manner, since the element attaching portion 2*b* of the present embodiment is configured so that the quantity ratio of the non-elastic yarns 9 is to be smaller than that of the elastic yarns 8, the weaving ratio of the elastic yarns 8 against the non-elastic yarns 9 at the element attaching portion 2*b* becomes larger than that at the tape main portion 2*a*. Here, in the present invention, arranging positions of the elastic yarns 8 and the non-elastic yarns 9 at the tape main portion 2*a* and the element attaching portion 2*b* is not specifically limited and can be appropriately varied as needed.

Further, in the fastener stringer 1 of the present embodiment, the continuous fastener element 3 is formed of synthetic resin such as polyamide or polyester, for example, and formed with monofilament of which section is a circular of 0.6 mm diameter. Specifically, the monofilament is processed to be bent so as to be wound as a coil-shape. Subsequently, stamping forming is performed on the monofilament so that plastically deformed portions are formed to be flat-shaped at predetermined intervals. In this manner, the coil-shaped continuous fastener element 3 is formed.

The continuous fastener element 3 which is formed as described above includes a coupling head 3*a*, upper and lower leg portions 3*b*, 3*c* which are extended from the coupling head 3*a* in the tape width direction, and a connecting portion 3*d* which connects the upper leg portion 3*b* of one fastener element 3 of the adjacent fastener elements 3 and the lower leg portion 3*c* of the other fastener element 3. Further, the continuous fastener element 3 is sewn to the element attaching portion 2*b* with double-thread chain stitch of the sewing yarn 5 together with a stretchable core thread 7 in a state that the core thread 7 is inserted between the upper and lower leg portions 3*b*, 3*c* while the coupling head 3*a* is projected from the tape side edge of the fastener tape 2. In this manner, the element row 4 is formed.

Here, in the present embodiment, a non-elastic twisted yarn which is formed by twisting polyester monofilament is used for the sewing yarn 5 which sews the continuous fastener element 3. Further, the core thread 7 is formed of a twisted yarn formed by twisting nine Spandex covered yarns, the covered yarn being constituted by winding a polyester filament yarn around the polyurethane elastic yarn.

The element row 4 which is sewn as described above to the element attaching portion 2*b* of the fastener tape 2 can be stably attached to the element attaching portion 2*b* since the core thread 7 is inserted between the upper and lower leg portions 3*b*, 3*c*. In addition, coupling operation for coupling the bilateral element rows 4 can be stabilized when a later-mentioned slide fastener 21 is configured.

In this case, the element row 4 is formed so that the pitch P between the coupling heads 3*a* of the adjacent fastener elements 3 in the tape longitudinal direction is to be 1.37 mm in the state that the element row 4 is sewn to the element attaching portion 2*b* and the fastener tape 2 is not stretched.

Further, in the fastener stringer 1 of the present embodiment to which the fastener element 3 is sewn, the elastic yarn 8 and the non-elastic yarn 9 are woven to the fastener tape 2 as described above. Accordingly, the fastener stringer 1 has stretchability capable of stretching 10% or more when a load of 1 kg for each 30 cm is applied in the tape longitudinal direction toward the fastener stringer, for example, and the fastener stringer 1 is formed to be capable of returning to the original state (original length) when the load is removed.

As illustrated in FIG. 3 and FIG. 4, the dimension of the coupling head 3*a* of the continuous fastener element 3 in the tape longitudinal direction is denoted as mountain length H and the dimension of the upper and lower leg portions 3*b*, 3*c* in the tape longitudinal direction is denoted as leg portion length d. In the fastener stringer 1 of the present embodiment, the mountain length H is set to be 1.18 mm and the leg portion length d is set to be 0.60 mm which corresponds to the wire diameter of the monofilament in the case of the present embodiment. Accordingly, in the present embodiment, the value of the bulging ratio (=mountain length H/leg portion length d) which is the ratio between the mountain length H and the leg portion length d is set to be 1.97.

Thus, in the fastener stringer 1 of the present embodiment, since the value of bulging ratio is set to be larger than 1.80, in particular, larger than 1.85, the dimension of the coupling head 3*a* in the tape longitudinal direction becomes larger than that in the fastener stringer of the related art, as illustrated in FIG. 3 and FIG. 4. Accordingly, the coupling of the coupling heads 3*a* of the bilateral fastener elements 3 can be stably maintained and occurrence of the chain breaking at the element rows 4 can be prevented even in the case that the element rows 4 are locally curved or bent in the tape front-back direction and the pitch P of the fastener element 3 is expanded when the element rows 4 receive the pushing force while the bilateral element rows 4 are coupled.

Further, in the fastener stringer 1, the value of the bulging ratio is set to be 2.33 or smaller, in particular, to be 2.13 or smaller. Thus, with the element rows 4, the coupling heads 3*a* of the fastener elements 3 which are adjacent in the tape longitudinal direction are not overlapped. Therefore, when a slide fastener 21 which is described later is configured with the fastener stringer 1, opening and closing operation of the slide fastener 21 can be smoothly performed without decreasing sliding easiness of a slider 22.

Further, in the fastener stringer 1 of the present embodiment, the pitch P of the continuous fastener element 3 which is sewn to the fastener tape 2 is set to be 1.37 mm. Accordingly, the coupling ratio (=(mountain length H+leg portion length d)/pitch P) which is the ratio between the sum of the mountain length H and the leg portion length d and the pitch P is set to be 1.30.

Thus, in the fastener stringer 1 of the present embodiment, since the value of the coupling ratio is set to be larger than 1.23, in particular, larger than 1.28, the coupling head 3*a* of one fastener element 3 can further enter between the upper and lower leg portions 3*b*, 3*c* of the other fastener element 3 of the coupling counterpart when the bilateral element rows 4 are coupled. Therefore, the coupling of the coupling heads 3*a* of the bilateral fastener elements 3 can be maintained further reliably even when the pitch P of the fastener element 3 is expanded due to the pushing force received by the element rows 4 in the coupled state.

Further, in the fastener stringer 1, the value of the coupling ratio is set to be 1.50 or smaller, in particular, to be 1.46 or smaller. Accordingly, overlapping of the coupling heads 3*a* of the adjacent fastener elements 3 can be reliably prevented and decrease of the operability of the slider 22 can be prevented when the slide fastener 21 is configured.

Figure 5:
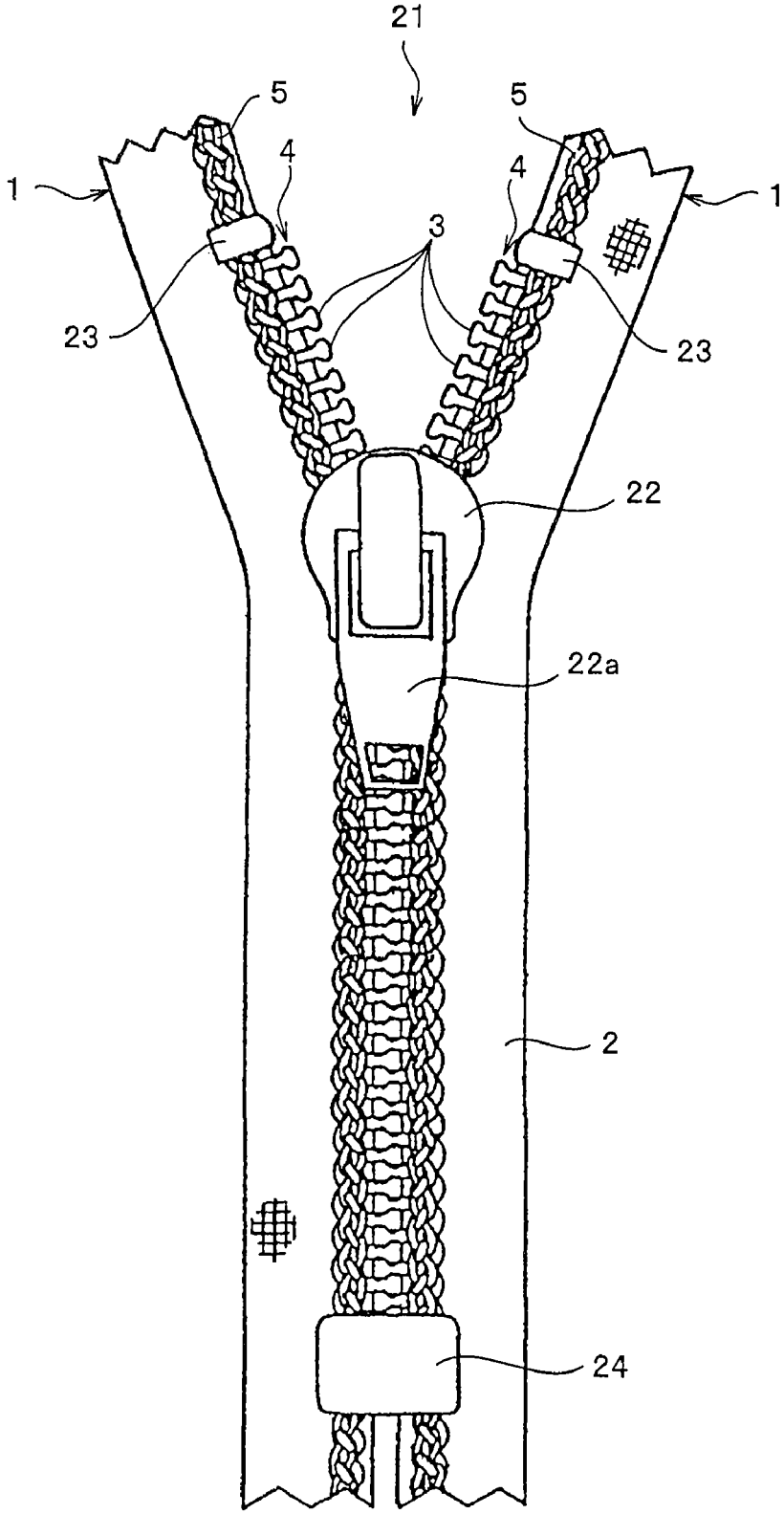
FIG. 5 is a front view which schematically illustrates the slide fastener according to the present invention.

Next, the slide fastener 21 which is configured with the abovementioned fastener stringer 1 of the present embodiment is described. FIG. 5 is a front view which schematically illustrates the slide fastener according to the present embodiment.

In the slide fastener 21 of FIG. 5, the slider 22 having a tab 22*a* is inserted through the element rows 4 of the fastener stringers 1. A top end stop 23 as a stopper is attached to the top end portion of the element row 4 and a bottom end stop 24 which connects both bottom end portions so as not to be separable is attached to the bottom end portions of the element rows 4. The slider 22 which is inserted through the element rows 4 is arranged slidably between the top end stop 23 and the bottom end stop 24. Here, in the present invention, it is also possible to configure the slider fastener so that a separable bottom end stop which is constituted of a separable pin, a box pin and a box is provided to enable the bottom end portions of the element rows 4 to be separated instead of the abovementioned bottom end stop 24.

The slide fastener 21 of the present embodiment has appropriate stretchability as described above since the elastic yarns 8 are woven into the tape main portion 2*a* and the element attaching portion 2*b* of the fastener tape 2 at predetermined ratios.

Further, in the slide fastener 21, the bulging ratio and coupling ratio of the continuous fastener element 3 are set to be the abovementioned values which are respectively within the predetermined ranges. Accordingly, the coupling of the coupling heads 3*a* of the bilateral fastener elements 3 can be stably maintained and occurrence of the chain breaking at the element rows 4 can be prevented even in the case that the pitch P of the fastener element 3 is expanded when the element rows 4 receive the pushing force while the bilateral element rows 4 are coupled. In addition, since the coupling heads 3*a* of the adjacent fastener elements 3 are not overlapped, the sliding operation of the slider 22 can be smoothly performed when coupling or separating the bilateral element rows 4.

Here, in the present embodiment, the continuous fastener element is formed with monofilament of which diameter is 0.6 mm. In the present invention, respective values such as the wire diameter of the monofilament (i.e., the leg portion length d), the mountain length H of the coupling head and the pitch P of the fastener element are not limited, provided that the bulging ratio which is the ratio between the mountain length H and the leg portion length d is set to be within the predetermined range. Accordingly, even in the case that the continuous fastener element is formed of monofilament of which diameter is 0.8 mm, for example, the continuous fastener element is simply needed to be formed to set the mountain length H of the coupling head so that the bulging ratio is larger than 1.80 and not larger than 2.33, preferably between 1.85 and 2.13 inclusive.

Further, in the present embodiment, the fastener stringer is used for a normal slide fastener in which the coupling head of the fastener element is projected from the selvedge of the element attaching portion side of the fastener tape. However, for example, the present invention can be applied in the same manner to a so-called concealed slide fastener in which the fastener element is attached to the element attaching portion so that the coupling head is arranged to the tape main portion side of the fastener tape and the fastener tape is folded to be U-shaped at the boundary between the tape main portion and the element attaching portion of the fastener tape so that the coupling head is projected outward from the U-shaped folded portion of the fastener tape.

EXAMPLES

In the following, the present invention is specifically described with reference to examples. However, the invention is not limited to the examples.

First, the fastener tape of which length is 80 cm or more is woven by using the elastic yarn and the non-elastic yarn which are respectively a Spandex covered yarn constituted by winding a polyester filament yarn around a polyurethane elastic yarn and a polyester processed yarn.

Here, as the warp yarns which form the tape main portion of the obtained fastener tape, two elastic yarns are arranged side by side after every six non-elastic yarns are arranged. Further, seven elastic yarns and two non-elastic yarns are woven at the element attaching portion and one non-elastic yarn is used for the warp yarn which is arranged at the selvedge of the fastener tape. From this non-elastic yarn toward the tape main portion side, one elastic yarn, one non-elastic yarn and six elastic yarns are arranged in order. Two pieces of such fastener tapes were coupled as a pair and four pairs of the bilateral fastener tapes were prepared.

Next, as the coil-shaped continuous fastener elements which were sewn to a pair of the bilateral fastener tapes, four kinds of continuous fastener elements formed of polyester monofilament were prepared as one pair each (Examples 1, 2, 3 and a Comparative example). The mountain length H and the leg portion length d of the examples are shown in the following Table 1 and the pitch thereof before being sewn to the fastener tape was 1.40 mm.

Then, by sewing the continuous fastener elements of the Examples 1, 2, 3 and the Comparative example respectively to the element attaching portions of four pairs of the bilateral fastener tapes, four kinds of fastener stringers having length of 80 cm or more were prepared. The following method was adopted to sew the continuous fastener elements respectively to each of the fastener tapes.

That is, first, the fastener tape is maintained to be linear by applying a predetermined magnitude of tension force to the fastener tape in the tape longitudinal direction. Next, a predetermined magnitude of tension force is applied to the continuous fastener element through which the core thread is inserted between the upper and lower leg portions, and then, the fastener element is placed on the element attaching portion of the fastener tape which is maintained linearly. Subsequently, the sewing needle is inserted through the core thread and the element attaching portion so that the continuous fastener element is sewn to the element attaching portion with double-thread chain stitch of the sewing yarn.

With the continuous fastener element which is sewn to the fastener tape as described above, the pitch P of the continuous fastener element after being sewn becomes 1.37 mm as shown in Table 1 because the tension force applied to the fastener tape etc. when the fastener element is sewn is removed after the sewing so as to be contracted in the tape longitudinal direction.

The mountain length H, the leg portion length d and the pitch P of each of the fastener stringers of the Examples 1, 2, 3 and the Comparative example which were obtained as described above were respectively measured and confirmed to be respective predetermined values. Subsequently, the bulging ratio and the coupling ratio were calculated based on the mountain length H, the leg portion length d and the pitch P. The calculation result is also shown in Table 1.

TABLE 1

| | Example 1 | Example 2 | Example 3 | Comparative example |
|---|---|---|---|---|
| Mountain length H (mm) | 1.10 | 1.18 | 1.28 | 1.06 |
| Leg portion length d (mm) | 0.60 | 0.60 | 0.60 | 0.60 |
| Pitch P (mm) | 1.37 | 1.37 | 1.37 | 1.37 |
| Bulging ratio | 1.83 | 1.97 | 2.13 | 1.77 |
| Coupling ratio | 1.24 | 1.30 | 1.37 | 1.21 |

TABLE 1-continued

| | | Example 1 | Example 2 | Example 3 | Comparative example |
|---|---|---|---|---|---|
| Push strength (N) | No load | 237 | 286 | 456 | 187 |
| | Load 1.0 kg | 129 | 177 | 293 | 102 |
| | Load 2.0 kg | 109 | 127 | 280 | 86 |
| | Load 3.0 kg | 91 | 120 | 211 | 75 |

A test to examine the push strength was performed for each of the fastener stringers of the Examples 1, 2, 3 and the Comparative example which were obtained as described above. The following method with a dedicated test apparatus was adopted for the test. First, the bilateral element rows of the fastener stringers are coupled. Then, predetermined magnitude of load is applied in the top-bottom direction of the fastener tape in the state that the element row is directed upward. In the state that the load is applied, the bilateral fastener tapes of the fastener stringers are held by grip portions of the test apparatus.

The bilateral grip portions is adjusted to be located so that the width dimension between the coupled element rows and the bilateral grip portions which hold the bilateral fastener tapes is to be 3 mm. Further, after the faster tapes are held by the bilateral grip portions, the pushing force to push the coupled bilateral element rows from the tape back surface side toward the front surface side is gradually applied.

The pushing force is to be increased, and then, the magnitude of the pushing force when the coupling of the bilateral element rows is disengaged and the element rows are separated is measured as the push strength of each of the fastener stringer. When the pushing force was applied to the element rows in the test of the push strength of this time, measurement of the push strength was performed in the case that no load was applied to the fastener tapes and in the cases that loads of 1.0 kg, 2.0 kg and 3.0 kg were respectively applied in the direction to be apart toward the top and bottom of the fastener tapes (longitudinal direction). The result of the measurement is also shown in Table 1.

As shown in Table 1, the bulging ratio and the coupling ratio of the fastener stringer of each of the Examples 1, 2 and 3 are respectively within the range of the present invention. That is, the range of the bulging ratio is larger than 1.80 and not larger than 2.33 and the range of the coupling ratio is larger than 1.23 and not larger than 1.50. It was examined that the push strength of each of the fastener stringers of the Examples 1, 2 and 3 was improved compared to the fastener stringer of the Comparative example which was formed with dimensions of the related art. The push strength of each of the Examples 1, 2 and 3 was obtained as a value of 200 N or larger in the case that no load was applied.

With a stretchable slide fastener, in particular, the push strength in the case that a load of at least 1.0 kg is applied is generally required to be 100 N or larger. The push strength of the fastener stringer of each of the Examples 1, 2 and 3 was obtained as a value larger than 100 N in the case that a load of 2.0 kg was applied. Therefore, it was examined that the element rows were resistant to occurring of the chain breaking even with applying the pushing force to the element rows.

The bulging ratio and the coupling ratio of the fastener stringer of the Example 2 are within further preferable range. That is, the bulging ratio is larger than 1.85 and not larger than 2.13 and the coupling ratio is larger than 1.28 and not larger than 1.46. Then, it became clear that the push strength of the fastener stringer of the Example 2 was remarkably improved.

What is claimed is:

1. A stretchable fastener stringer for a slide fastener comprising:

a fastener tape which includes a tape main portion and an element attaching portion and a continuous fastener element which is attached to the element attaching portion of the fastener tape, the fastener tape has stretchability due to an elastic yarn being woven or knitted into the tape main portion and the element attaching portion, the fastener element includes a coupling head, upper and lower leg portions which are extended from the coupling head toward the tape width direction and which are attached to the element attaching portion and a connecting portion which connects the upper and lower leg portions therebetween of adjacent fastener elements, and wherein a value of a bulging ratio (=mountain length H/leg portion length d) which is the ratio between mountain length H as a dimension of the coupling head in the tape longitudinal direction and leg portion length d as a dimension of the upper and lower leg portions in the tape longitudinal direction is set to be larger than 1.80 and not larger than 2.33.

2. The stretchable fastener stringer according to claim 1, wherein a value of a coupling ratio (=(mountain length H+leg portion length d)/pitch P) which is the ratio between a sum of the mountain length H and the leg portion length d and a pitch P between the coupling heads in the tape longitudinal direction of the fastener elements which are adjacent each other is set to be larger than 1.23 and not larger than 1.50.

3. The stretchable fastener stringer according to claim 2, wherein the fastener element is sewn to the element attaching portion with a sewing yarn.

4. The stretchable fastener stringer according to claim 3, wherein a stretchable core thread is inserted between the upper and lower leg portions of the fastener element.

5. The stretchable fastener stringer according to claim 2, wherein the fastener element is attached by weaving or knitting simultaneously when the fastener tape is woven or knitted.

6. A slide fastener including the stretchable fastener stringer according to claim 2.

7. The stretchable fastener stringer according to claim 1, wherein the fastener element is sewn to the element attaching portion with a sewing yarn.

8. The stretchable fastener stringer according to claim 7, wherein a stretchable core thread is inserted between the upper and lower leg portions of the fastener element.

9. The stretchable fastener stringer according to claim 1, wherein the fastener element is attached by weaving or knitting simultaneously when the fastener tape is woven or knitted.

10. A slide fastener including the stretchable fastener stringer according to claim 1.

* * * * *